United States Patent [19]

Johnson

[11] Patent Number: 4,909,457

[45] Date of Patent: Mar. 20, 1990

[54] YARN CONTAINING AND DISPENSING DEVICE AND METHOD OF USE OF THE SAME

[76] Inventor: Bruce W. Johnson, 610—34th Ave. N., Minneapolis, Minn. 55412

[21] Appl. No.: 214,190

[22] Filed: Jun. 30, 1988

[51] Int. Cl.[4] ..... B65H 49/08

[52] U.S. Cl. ..... 242/138; 242/146

[58] Field of Search ..... 242/132, 134, 137, 137.1, 242/138, 146, 141, 170, 171, 55.53; 206/409, 388

[56] References Cited

U.S. PATENT DOCUMENTS

| | | | |
|---|---|---|---|
| 163,742 | 5/1975 | Cleveland . | |
| 294,312 | 2/1884 | Earl . | |
| 474,518 | 5/1892 | Bishop | 242/55.53 |
| 751,214 | 2/1904 | Steeb | 242/146 |
| 1,024,958 | 4/1912 | Williams | 242/146 |
| 1,268,633 | 6/1918 | Scheuer | 206/409 X |
| 1,401,811 | 12/1921 | Myers, Jr. | 242/146 |
| 1,483,729 | 2/1924 | Isted | 242/138 |
| 1,541,562 | 6/1925 | Gilbert et al. | 242/146 |
| 1,553,275 | 9/1925 | Washburn | 242/146 |
| 1,688,923 | 10/1928 | Harris | 242/146 |
| 1,827,000 | 10/1931 | Duffin | 242/137 |
| 3,145,646 | 8/1964 | Levy | 242/146 |
| 4,537,366 | 8/1985 | Swenson | 242/137 |

FOREIGN PATENT DOCUMENTS

| | | | |
|---|---|---|---|
| 23299 | 6/1935 | Australia | 242/146 |
| 720109 | 12/1954 | United Kingdom | 242/146 |
| 908396 | 3/1960 | United Kingdom | 242/146 |

*Primary Examiner*—Katherine A. Matecki

*Attorney, Agent, or Firm*—Mercant, Gould, Smith, Edell, Welter & Schmidt

[57] ABSTRACT

This device relates to a yarn containing and dispensing device adapted for dispensing axially-winding and peripheral-winding skeins of yarn. This device includes a container having mating longitudinal top and bottom members with end members at each end. When closed, the top and bottom members define a longitudinal gap therebetween for dispensing yarn from a peripherally-winding skein. Further, when closed, the end members define an aperature for dispensing yarn from an axially-winding skein. Alternatively, the aperture retains a spindle for supporting a peripherally-winding skein.

6 Claims, 2 Drawing Sheets

YARN CONTAINING AND DISPENSING DEVICE AND METHOD OF USE OF THE SAME

FIELD OF THE INVENTION

The present invention relates in general to the field of closable containers, and in particular to a device for containing skeins of yarn from which yarn may be dispensed and to methods of use of such a device.

BACKGROUND OF THE INVENTION

Yarn, as purchased, generally is wound on a skein in one of two ways: (1) such that the yarn may be unwound from the skein by pulling the loose outer end from the periphery of the skein "peripheral-winding skein", or (2) such that the yarn may be unwound from the skein by pulling the loose central end from the center of the skein along the skein's axis (an "axial-winding skein"). Throughout this discussion, these terms will be used when describing the unwinding of yarns for use without regard to how the yarn is actually wound into a skein by the manufacturer. Certain skeins are capable of use by pulling on either end and such a skein would be called herein by both names depending on which end of the yarn is used. Either type of skein is likely to knot or tangle if used as purchased, so typically a knitter will rewind the entire skein into a ball before beginning to knit with the yarn. In this way, the knitter can knit continuously from the ball without having to stop to untangle knots. Continuous, uninterrupted knitting is advantageous since the knitter is better able to maintain similar tension in the stitches throughout the knitted product.

Knitting from the yarn ball, however, has some disadvantages. When dropped, the ball of yarn has a tendency to roll; the knitter must then chase the ball of yarn and rewind the length of yarn unwound during the ball's travel. Knitting from a ball of yarn can be an inconvenience since the process of unwinding the yarn may cause the ball to roll away from the knitter. Further, the ball of yarn is an attractive play thing for pets. Yarn is typically a relatively loosely-woven multi-ply material, which is particularly prone to snagging. Thus, pets or sharp corners can easily damage exposed yarn. Snags in the yarn result in a flaw in the knitted product, and therefore are undesirable.

A variety of devices are known for dispensing twine, string, ribbon or the like. Typically, however, these devices are not adaptable for use with both peripheral- and axial-winding spools or skeins. Further, many of these devices do not include safeguards to protect the string or thread from snagging or fraying, since snagging is less of a concern with single-ply or tightly woven multi-ply materials than it is with yarn. Many of these devices include a cutting edge for severing the material contained. Such a feature is undesirable for a yarn-dispensing device since it creates a risk of fraying or cutting the yarn. Cutting a piece of yarn used in knitting a garment can be problematic since it is often desirable to have the entire piece made from a single uncut piece of yarn.

Thus, an easily transportable container for protecting yarn from snagging or fraying, adapted to dispense peripheral-winding as well as axial-winding skeins of yarn would be advantageous.

SUMMARY OF THE INVENTION

A yarn containing and dispensing device according to the present invention comprises an elongate tubular container or vessel and an axial support means or spindle. The container defines a yarn-receiving cavity or recess and includes mating top and bottom members. The top and bottom members mate in such a way that a yarn-dispensing gap remains between the top and bottom members when the container is closed. The gap has a particular, snag-safe, tangle-reducing geometry for dispensing yarn from "peripheral-winding" skeins. At least one end of the container includes a yarn-dispensing recess or aperture generally centered on the end of the container for dispensing yarn from an "axial-winding" skein. The top and bottom members further include a spindle-receiving means, to support the spindle for use with a peripheral-winding skein.

In the preferred embodiment, the top and bottom members are generally elongate semi-cylindrical shells or sleeves with semi-circular end caps or end members on each end. The spindle- receiving means includes semi-circular apertures on the end members of the top and bottom members. The bottom member includes a ground-engaging means which, in the preferred embodiment, comprises ground-engaging legs to give the container stability on a flat surface. The top member includes a carrying means or handle for easy transportation of the device In the preferred embodiment, the spindle includes a stopping means to retain the spindle in the container in use. The stopping means may simply consist of a portion of the spindle having a greater diameter than the recesses in the end members, so that axial displacement of the spindle is prohibited.

The preferred embodiment further includes a latching means disposed so as not to interfere with the yarn-dispensing gap or the yarn-dispensing aperture on the container end.

A method of using the yarn containing device described with an axial-winding skein and a method of using the yarn containing device with a peripheral-winding skein are also disclosed. For use with a peripheral-winding skein, the spindle is passed through the axis of the skein of yarn. The spindle is then placed in the spindle receiving means with the free end of the yarn passing over the edge of the bottom of the container. The container is then closed and latched to secure the yarn within the container. Finally, the yarn is pulled from the device as required through the gap, such that the yarn may traverse the length of the gap as it is pulled.

For use with an axial-windinq skein, the skein of yarn, as purchased, rests in the bottom member of the container. No spindle is used. The loose end of the skein is positioned in the yarn-dispensing aperture at one end of the container. Next, the container is closed and latched to secure the yarn within the container. Finally, the yarn is pulled through the yarn- dispensing aperture as desired.

BRIEF DESCRIPTION OF THE DRAWINGS

In the drawings, wherein like reference numerals indicate corresponding parts throughout the several views.

DETAILED DESCRIPTION OF THE INVENTION

Figure 1:
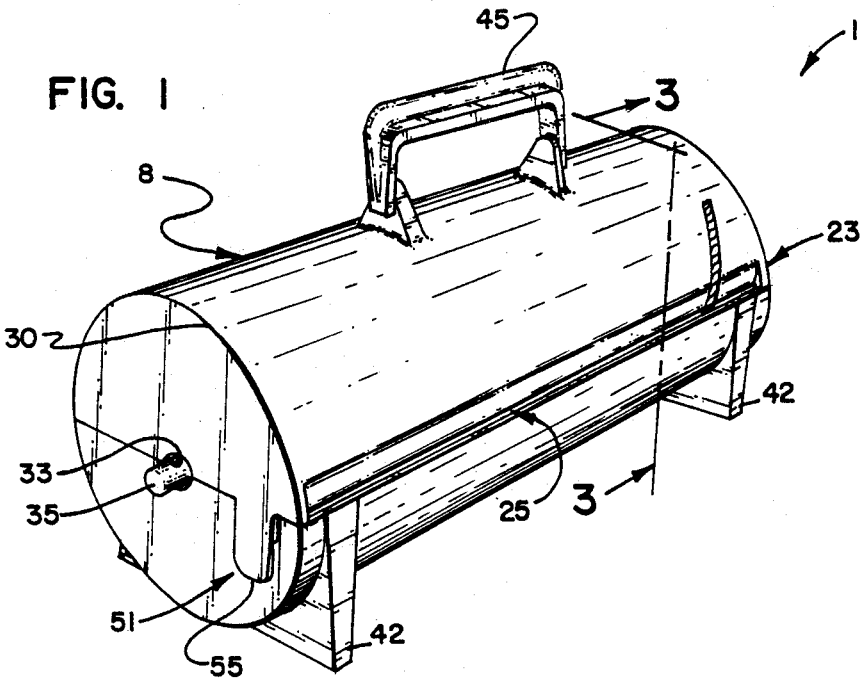
FIG. 1 is a perspective view of the preferred embodiment of a yarn containing and dispensing device according to this invention.

The reference numeral 1 generally designates a yarn containing and dispensing device according to this invention.

Figure 2:
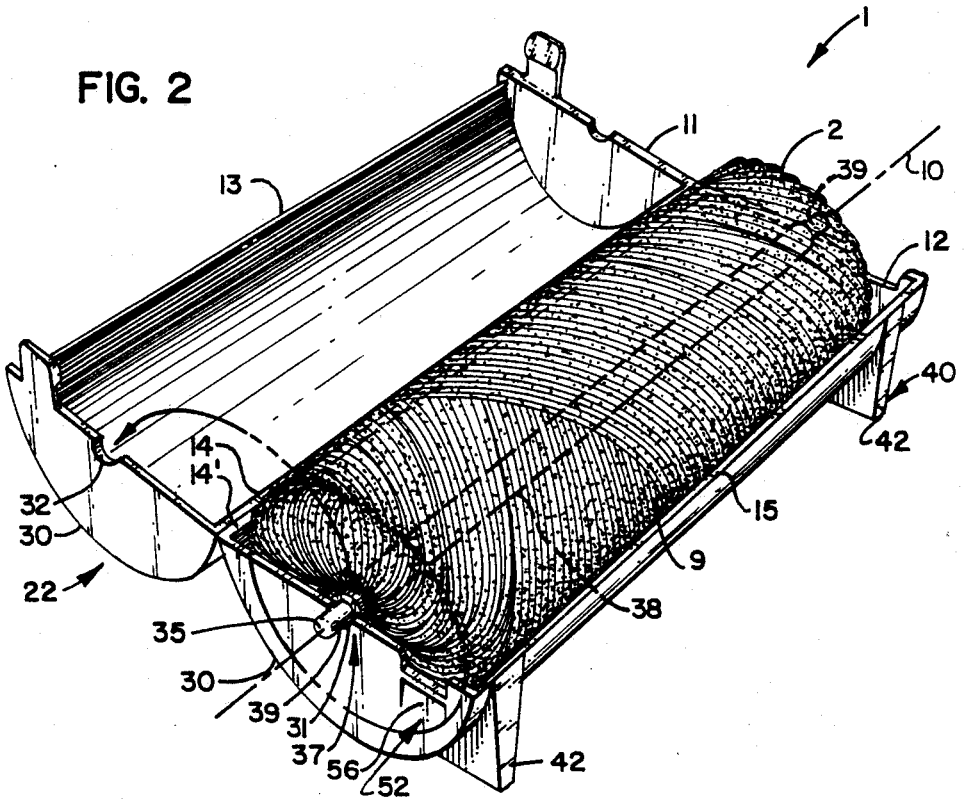
FIG. 2 is a perspective view of a yarn containing and dispensing device according to this invention in an open position, with a peripheral-winding skein of yarn contained therein.
Figure 3:
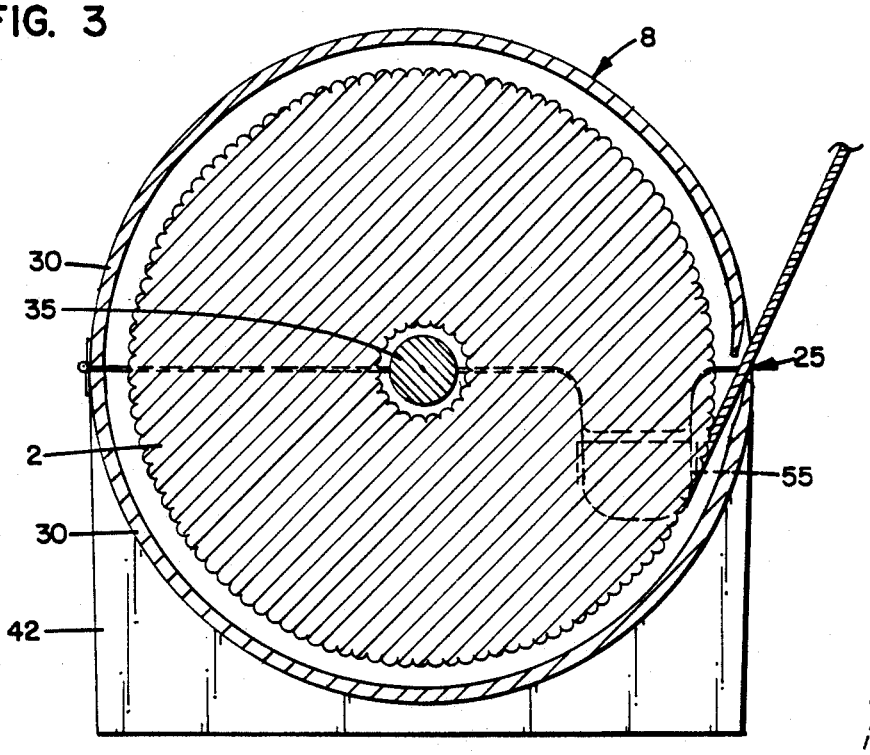
FIG. 3 is a cross-sectional view of the yarn containing and dispensing device according to this invention as seen generally along line 3-3 in FIG. 1 with the peripheral-winding skein of yarn contained therein.
Figure 4:
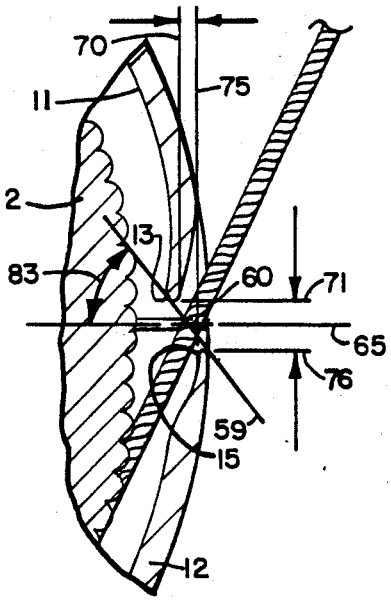
FIG. 4 is a partial cross-sectional view similar to FIG. 3 but on an enlarged scale, showing the gap formed between the top and bottom members of the container, with the peripheral-winding skein of yarn contained therein.
Figure 5:
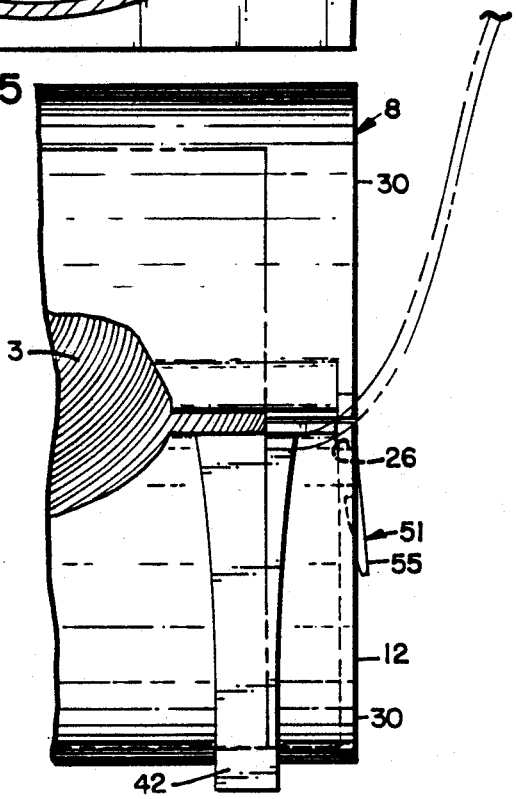
FIG. 5 is a side elevational view of a yarn containing and dispensing device according to this invention, with a portion of the container shown in partial sectional view.

Yarn, as purchased, typically comes in one of two kinds of skeins: (1) a "peripheral-winding skein" 2, as shown in FIGS. 2, 3 and 4; and (2) an "axial-winding skein" 3, as shown in FIG. 5. The yarn containing and dispensing device 1 according to this invention can be used for either type of skein. In the preferred embodiment, the container 8 is elongate and tubular and defines a yarn-receiving cavity 9. The preferred container 8 is generally symmetrical about an axis 10. The container 8 includes a mating top member 11 and bottom member 12, which, in the preferred embodiment, are each semi-cylindrical members. The top member 11 includes a first longitudinal edge 13 and a second longitudinal edge 14; the bottom member 12 includes a first longitudinal edge 15 which mates with first longitudinal edge 13 and a second longitudinal edge 14 which mates with second longitudinal edge 14 of the top member 11. The second edge 14 of the top member 11 is hingeably connected to the second edge 14' of the bottom member 12. The top member 11 is moveable from a first position 22 (see FIG. 2) wherein the container is substantially open to a second position 23 wherein the container is substantially closed (see FIG. 1). The top member 11 and the bottom member 12 are adapted such that when the container is substantially closed, a yarn-dispensing gap 25 remains between the first edge 13 of the top member 11 and the first edge 15 of the bottom member 12 for dispensing yarn from a peripheral-winding skein 2 in use. Gap 25 will be described in greater detail below. The container 8 further includes a yarn-receiving aperture 26 at at least one end of the container for dispensing yarn from an axial-winding skein 3 in use.

In the preferred embodiment, the top member 11 and the bottom member 12 each include semi-circular mating end members 30. These end members 30 include spindle-receiving means 31 generally located at the center of the mating end members 30. The spindle-receiving means 31 of the preferred embodiment includes semi-circular spindle-receiving apertures 32 which mate to form circular apertures 33 when the container is substantially closed. A preferred spindle-receiving aperture 32 may also function as a yarn-dispensing aperture 26.

A spindle member 35 is received by the spindle-receiving means 31 when the device is used for peripheral-winding skeins of yarn. The device 1 includes a spindle retaining means 37. In the preferred embodiment, the retaining means 37 is a middle portion 38 between end portion 39 of the spindle member 35 which has a greater diameter than the diameter of the circular apertures 33. End portions 39 have diameters slighter smaller than the diameter of the circular apertures 33 for rotational receipt therein.

In the preferred embodiment, the bottom member 12 includes a ground-engaging means 40 such as ground-engaging legs 42. The top member 11 may also include a handle member 45 for easy transportation of the device 1.

The preferred container 8 may also include a latching means for securing the top member 11 to the bottom member 12 in the second position 23. The latching means may include a first engagement member 51 and a second engagement member 52; one of the engagement members is disposed on the top member 11 and the other of the engagement members is disposed on the bottom member 12. In the embodiment shown in FIGS. 1, 2 and 5, the first engagement member 51 includes a resilient tang 55 on the top member 11 of the container 10, and the second engagement member includes a recess 56 in the bottom member 12 for receiving the resilient tang 55.

The gap 25 is best illustrated in FIG. 4. As previously stated, the yarn-dispensing gap 25 lies in a gap plane 59 which is defined by first edge 13 of the top member 11 and the first edge 15 of the bottom member 12. The gap 25 is bisected by a centerline 60 which passes along the gap. Centerline 60 and the container axis 10 define a radial plane 65. First edge 13 of the top member 11 lies at the intersection of a first plane 70 and a second plane 71. First plane 70 is perpendicular to the radial plane 65. Second plane 71 is parallel to and spaced from the radial plane 65. First edge 15 of the bottom member 12 lies at the intersection of a third plane 75 and a fourth plane 76. Third plane 75 is perpendicular to the radial plane 65, and parallel to and spaced from the first plane 70. Fourth plane 76 is parallel to and spaced from the radial plane 65 and parallel to and spaced from the second plane 71. First plane 70 and third plane 75 are closer together than are second plane 71 and fourth plane 76. The first plane 70 is nearer the axis 10 than is third plane 75. In other words, the gap plane 59 is disposed at an angle 83 to the radial plane 65, where angle 83 is greater than 45.. It is to be understood that while radial plane 65 is horizontal in the preferred embodiment, and the above example is given in the horizontal mode, this orientation is not essential to the advantageous use of this invention, specifically almost any orientation of the gap with respect to the axis would likely produce generally satisfactory results.

As best shown in FIG. 2, this device can be used with peripheral-winding skeins 2 of yarn. The spindle member 35 is passed through the peripheral-winding skein 2 of yarn, and the spindle member 35 is placed in the spindle-receiving means 31. The container top member 11 is moved to the second closed position 23, in mating relationship with bottom member 12, and the latching means 50 is engaged, as shown in FIG. 1. As shown in FIGS. 3 and 4, yarn is dispensed through the yarn-dispensing gap 25. As the yarn is pulled through the gap 25, the skein 2 rotates about the spindle member 35. The yarn pulled from the container is free to traverse substantially the entire length of the gap 25, with the tension in the pulled yarn remaining substantially constant throughout the traverse. The skein will be generally supported by the spindle and will rotate about this spindle, or the spindle will turn in the openings 33 in the end members 30.

In use with an axial-winding skein 3, as shown in FIG. 5, the skein 3 rests generally in the bottom member 12 of the container 8. No spindle member 35 is used. The loose end of the yarn is pulled through the yarn-dispensing aperture 26.

It will be understood that the present invention may be embodied in a variety of forms. The above descriptions, therefore, are not to be interpreted as limiting, but rather as a basis for the claims and as a basis for teaching persons skilled in the art the invention, which is defined by the following claims.

What is claimed is:

1. A yarn containing and dispensing device adapted for selectively dispensing peripheral-winding yarn and axial-winding yarn, said device comprising:

means for retaining a skein of yarn, said skein retaining means including a container having a longitudinal axis, a mating top, a ground-engaging bottom and end members at each end of the top and bottom members, said top, bottom and end members defining a yarn-receiving cavity;

said container including generally semi-circular apertures in each of said end members, and a yarn-dispensing gap defined between said top and said bottom, along substantially the entire length of said container, said gap lying in a gap plane defined by mating longitudinal edges of said top member and said bottom member, a second plane being defined by the longitudinal axis of said container and a longitudinal centerline of said gap, said gap plane and said second plane defining an angle greater than 45 degrees, wherein said longitudinal edge of said top member lies closer to the longitudinal axis of said container than said mating longitudinal edge of said bottom member;

wherein said yarn-dispensing gap comprises means for dispensing yarn from a peripheral-winding yarn skein, and said semi-circular apertures in said end members comprise means for selectively retaining a spindle for supporting said peripheral-winding yarn skein and for dispensing yarn from an axial-winding yarn skein.

2. A yarn containing and dispensing device according to claim 1 further comprising means for hingeably connecting said top and said bottom together.

3. A yarn containing and dispensing device according to claim 1, wherein said container includes an engagement means having a first engagement member and a second engagement member, said top member including one of said engagement members, and said bottom including a second of said engagement members.

4. A yarn containing and dispensing device according to claim 3, wherein said first engagement member is a resilient tang, and said second engagement member is a recess for receiving said resilient tang.

5. A yarn containing and dispensing device according to claim 1, wherein said top member includes a handle member.

6. A yarn containing and dispensing device according to claim 1 wherein said container includes means to prevent axial displacement of said spindle in said container.

* * * * *

UNITED STATES PATENT AND TRADEMARK OFFICE

CERTIFICATE OF CORRECTION

PATENT NO. : 4,909,457

DATED : March 20, 1990

INVENTOR(S) : Johnson, Bruce

It is certified that error appears in the above-identified patent and that said Letters Patent is hereby corrected as shown below:

Front page, firm name
"Mercant" should be --Merchant--

Abstract, line 9
"aperature" should be --aperture--

Col.2, line 53
"windinq" should be --winding--

Col.3, line 39
"14" should be --14'--

Col.4, line 6
"slighter" should be --slightly--

Col.4, line 48
"45.." should be --45°--

Signed and Sealed this

Ninth Day of April, 1991

*Attest:*

*Attesting Officer*

HARRY F. MANBECK, JR.

*Commissioner of Patents and Trademarks*